US011203502B2

(12) United States Patent
Takano

(10) Patent No.: US 11,203,502 B2
(45) Date of Patent: Dec. 21, 2021

(54) SHEET DISCHARGE TRAY AND IMAGE FORMING APPARATUS

(71) Applicant: KYOCERA Document Solutions Inc., Osaka (JP)

(72) Inventor: Yusuke Takano, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 201 days.

(21) Appl. No.: 16/366,615

(22) Filed: Mar. 27, 2019

(65) Prior Publication Data

US 2019/0308842 A1 Oct. 10, 2019

(30) Foreign Application Priority Data

Apr. 6, 2018 (JP) ..... JP2018-073612

(51) Int. Cl.
*B65H 31/20* (2006.01)
*B41J 13/10* (2006.01)

(52) U.S. Cl.
CPC ..... *B65H 31/20* (2013.01); *B41J 13/106* (2013.01); *B65H 2405/1111* (2013.01); *B65H 2405/11151* (2013.01); *B65H 2405/11164* (2013.01); *B65H 2405/111646* (2013.01)

(58) Field of Classification Search
CPC ..... B65H 31/20; B65H 31/00; B65H 2405/11646; B65H 2405/1111; B65H 2405/11164; B65H 2405/11151
See application file for complete search history.

(56) References Cited

U.S. PATENT DOCUMENTS

| | | | | |
|---|---|---|---|---|
| 6,428,000 | B1 * | 8/2002 | Hara | B65H 31/20 271/207 |
| 9,598,257 | B2 * | 3/2017 | Komuro | B65H 1/266 |
| 10,836,599 | B2 * | 11/2020 | Shimmachi | B65H 31/20 |
| 2018/0022564 | A1 * | 1/2018 | Obara | B65H 31/20 271/223 |
| 2019/0144230 | A1 | 5/2019 | Obara et al. | B65H 31/20 |

FOREIGN PATENT DOCUMENTS

| | | |
|---|---|---|
| CN | 107628468 A | 1/2018 |
| JP | 2006-69677 A | 3/2006 |

* cited by examiner

*Primary Examiner* — Patrick Cicchino
(74) *Attorney, Agent, or Firm* — Sein IP, LLC

(57) ABSTRACT

A discharge tray has a frame, a first tray, a second tray, and an angle switching member. The first tray has a sheet-discharge-direction downstream side inclined upward. The second tray is movable, along a pair of wall portions on the frame, to a first position where at least part of the second tray overlaps the first tray, a second position to which the second tray extends toward the sheet-discharge-direction downstream side, and a third position to the sheet-discharge-direction downstream side of the second position where the second tray is rotatable. As the second tray moves, the angle switching member moves. At the third position, the angle switching member rotates through a predetermined angle and is held by the wall portions. The angle switching member supports the second tray at a second inclination angle smaller than a first inclination angle when the second tray is at the second position.

15 Claims, 11 Drawing Sheets

SHEET DISCHARGE TRAY AND IMAGE FORMING APPARATUS

INCORPORATION BY REFERENCE

This application is based upon and claims the benefit of priority from the corresponding Japanese Patent Application No. 2018-073612 filed on Apr. 6, 2018, the entire contents of which are incorporated herein by reference.

BACKGROUND

The present disclosure relates to a sheet discharge tray and an image forming apparatus.

In an image forming apparatus, a sheet on which an image has been formed is discharged from a discharge portion onto a sheet discharge tray. The sheet discharge tray is inclined upward away from the discharge portion. With the sheet discharge tray configured in this fashion, a sheet discharged moves toward the discharge portion under the self weight. Discharged sheets thus move toward the discharge portion side to make contact with an upright wall where the discharge portion is provided, and consequently the discharged sheets lie on one another at a given position on the sheet discharge tray.

A sheet on which an image has been formed may be curled due to various causes. If curled sheets are stacked one after another on the sheet discharge tray, some may partly move out of the sheet discharge tray and some may jam in the discharge portion, preventing stable reception of sheets.

SUMMARY

According to one aspect of the present disclosure, a sheet discharge tray includes a frame, a first tray, a second tray, and an angle switching member. The frame includes a bottom portion and a pair of wall portions that is provided at the opposite ends of the bottom portion in the width direction perpendicular to the sheet discharge direction and that extends in the sheet discharge direction. The first tray is fixed to the frame over the bottom portion, and the downstream side of the first tray in the sheet discharge direction is inclined upward. The second tray is supported, movably in the sheet discharge direction, on the pair of wall portions between the bottom portion and the first tray. The angle switching member is supported movably on the pair of wall portions under the second tray. The second tray is movable to a first position at which at least part of the second tray overlaps the first tray, a second position to which the second tray is extended by being moved toward the downstream side in the sheet discharge direction relative to the frame, and a third position which is to the downstream side of the second position in the sheet discharge direction at the third position, the second tray is rotatable about, as a pivot, its upstream side in the sheet discharge direction. In coordination with the movement of the second tray, the angle switching member moves along the pair of wall portions and, at a downstream-side end part of the pair of wall portions in the sheet discharge direction, the angle switching member rotates through a given angle and is then held by the pair of wall portions. When the second tray is at the third position, the angle switching member supports the second tray at a second inclination angle smaller than the first inclination angle when the second tray is at the second position.

Further features and advantages of the present disclosure will become apparent from the description of embodiments given below.

DETAILED DESCRIPTION

Figure 1:
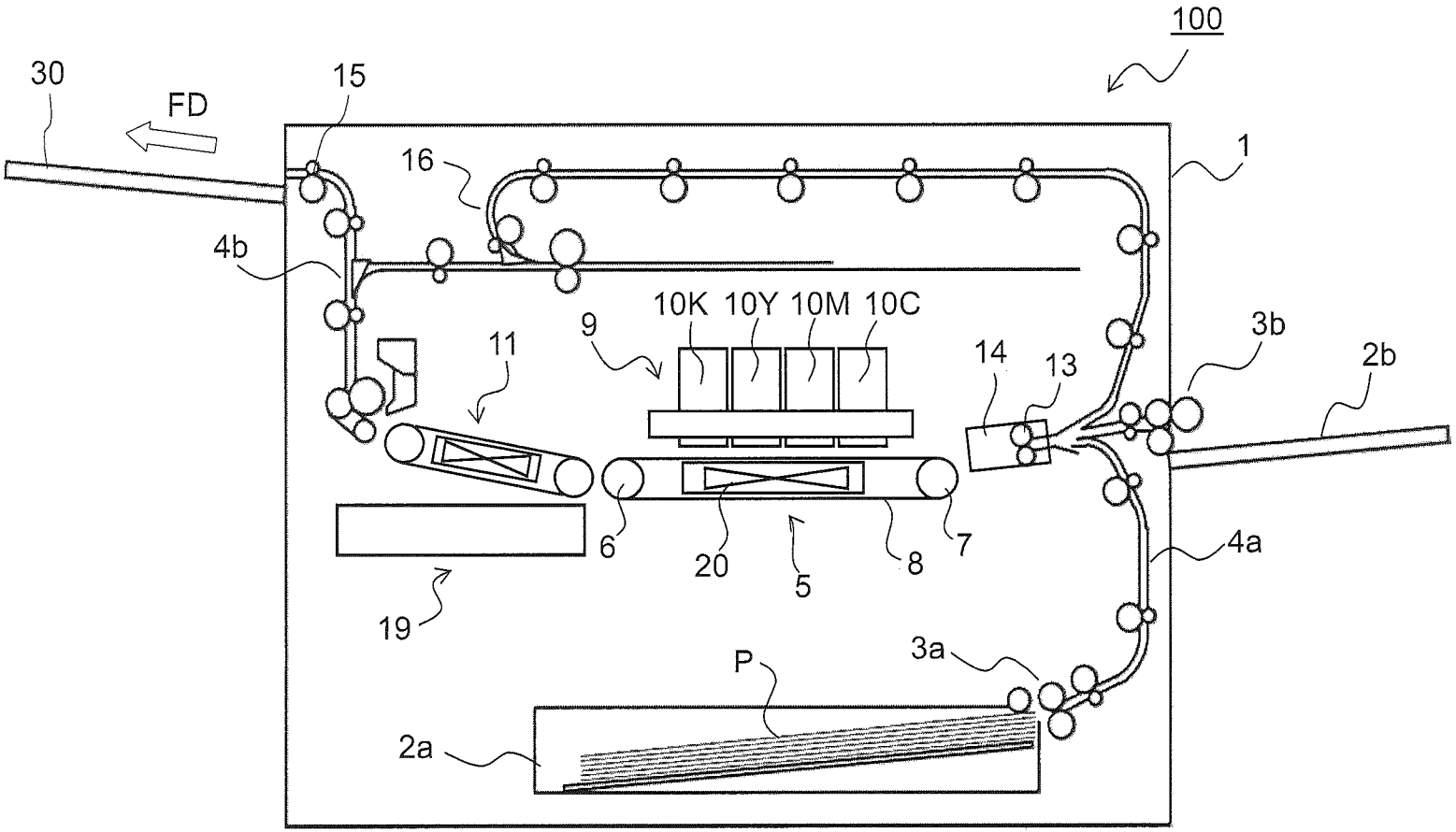
FIG. 1 is a side sectional view showing a schematic structure of a printer of an inkjet-recording type including a sheet discharge tray according to an embodiment.

Hereinafter, embodiments will be described with reference to the drawings. FIG. 1 is a side sectional view showing a schematic structure of a printer 100 of an inkjet-recording type, which includes a sheet discharge tray according to an embodiment. In the following description, the direction in which a sheet discharged from a discharge roller pair 15 provided in the printer 100 moves on a first tray 312 and on a second tray 32 will be referred to as the sheet discharge direction FD. Hereinafter, the direction may be referred to simply as the sheet discharge direction FD. Herein, "up" and "down" are defined based on the operational state of the printer 100. Further, "right" and "left" are defined based on the state shown in FIG. 1.

As illustrated in FIG. 1, the printer 100 includes a sheet feed cassette 2*a* that is arranged, as a sheet container, in a lower part inside a printer main body 1, and a manual sheet feed tray 2*b* that is provided outside the right side face of the printer main body 1. On the downstream side (in FIG. 1, the right side) of the sheet feed cassette 2*a* in the sheet conveyance direction, above it, a sheet feed device 3*a* is arranged. On the downstream side (in FIG. 1, the left side) of the manual sheet feed tray 2*b* in the sheet conveyance direction, a sheet feed device 3*b* is arranged. The sheet feed devices 3*a* and 3*b* separate and feed out sheets P one by one.

Inside the printer 100, a first sheet conveying passage 4*a* is provided. The first sheet conveying passage 4*a* is located to the upper right of the sheet feed cassette 2*a* and is located to the left of the manual sheet feed tray 2*b*. A sheet P fed out from the sheet feed cassette 2*a* is conveyed vertically upward along a side face of the printer main body 1 through the first sheet conveying passage 4*a*, and a sheet fed out from the manual sheet feed tray 2*b* is conveyed approximately horizontally leftward through the first sheet conveying passage 4*a*.

At the downstream end of the first sheet conveying passage 4*a* with respect to the sheet conveyance direction, a sensor unit 14 is arranged which senses the position (edge position) of an end part of the sheet P in the width direction (the direction perpendicular to the sheet conveyance direction). Near the sensor unit 14 on its downstream side, a first belt conveying portion 5 and a recording portion 9 are arranged.

The sensor unit 14 is provided with a registration roller pair 13. The registration roller pair 13 on one hand corrects skewed feeding of the sheet P, and on the other hand feeds out the sheet P toward the first belt conveying portion 5 with timing coordinated with the ink ejection operation performed by the recording portion 9. The structure of the sensor unit 14 will be described in detail later.

The first belt conveying portion 5 includes a first conveying belt 8, which is an endless belt and is wound around a first driving roller 6 and a first driven roller 7. The first conveying belt 8 is provided with a large number of perforations (unillustrated) for air suction. A sheet P fed out from the registration roller pair 13 passes under the recording portion 9 in a state held by suction on the first conveying belt 8 by a sheet suction portion 20 provided inside the first conveying belt 8.

The recording portion 9 includes line heads 10C, 10M, 10Y, and 10K. The line heads 10C to 10K record an image on the sheet P conveyed in a state held by suction on a conveying surface of the first conveying belt 8. The line heads 10C to 10K are fed with ink of four colors (cyan, magenta, yellow, and black), respectively, stored in corresponding ink tanks (unillustrated).

The line heads 10C to 10K eject their respective ink toward the sheet P sucked on the first conveying belt 8, and thereby, on the sheet P, a full-color image is recorded that has ink of four colors, namely cyan, magenta, yellow, and black, overlaid together. The printer 100 can record a monochrome image as well.

On the downstream side (in FIG. 1, the left side) of the first belt conveying portion 5 in the sheet conveyance direction, a second belt conveying portion 11 is arranged. The sheet P having had an image recorded on it in the recording portion 9 is fed to the second belt conveying portion 11, and while it passes through the second belt conveying portion 11, the ink having been ejected onto the surface of the sheet P is dried. The second belt conveying portion 11 has a similar structure as the first belt conveying portion 5, and therefore no overlapping description will be repeated.

On the downstream side of the second belt conveying portion 11 with respect to the sheet conveyance direction, a second sheet conveying passage 4*b* is provided. When no duplex recording is performed, the sheet P having the ink on it dried at the second belt conveying portion 11 is discharged from the second sheet conveying passage 4*b* via the discharge roller pair 15 onto a sheet discharge tray 30 provided outside the left side face of the printer 100. When duplex recording is performed on the sheet P, the sheet P having undergone recording on one side and having passed through the second belt conveying portion 11 passes through the second sheet conveying passage 4*b* to be conveyed to a reverse conveyance passage 16. The sheet P fed to the reverse conveyance passage 16 has its conveying direction switched so as to be reversed upside down, and then the sheet P passes through an upper part of the printer 100 to be conveyed to the registration roller pair 13. Then, the sheet P is conveyed, with its unrecorded side up, once again to the first belt conveying portion 5.

Under the second belt conveying portion 11, a maintenance unit 19 is arranged. When maintenance operation is performed for recording heads in the line heads 10C to 10K, the maintenance unit 19 moves to under the recording portion 9 to remove ink ejected (purged out) from ink ejection nozzles of the recording heads and collect the removed ink.

Figure 2:
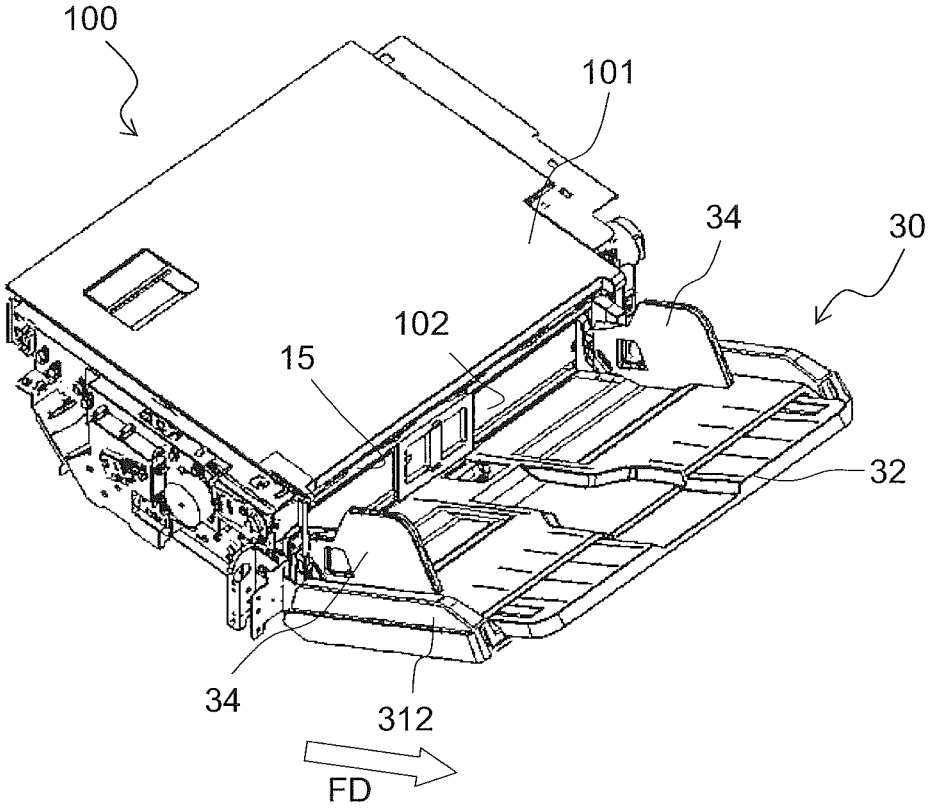
FIG. 2 is a perspective view of the sheet discharge tray attached to the printer.
Figure 3:
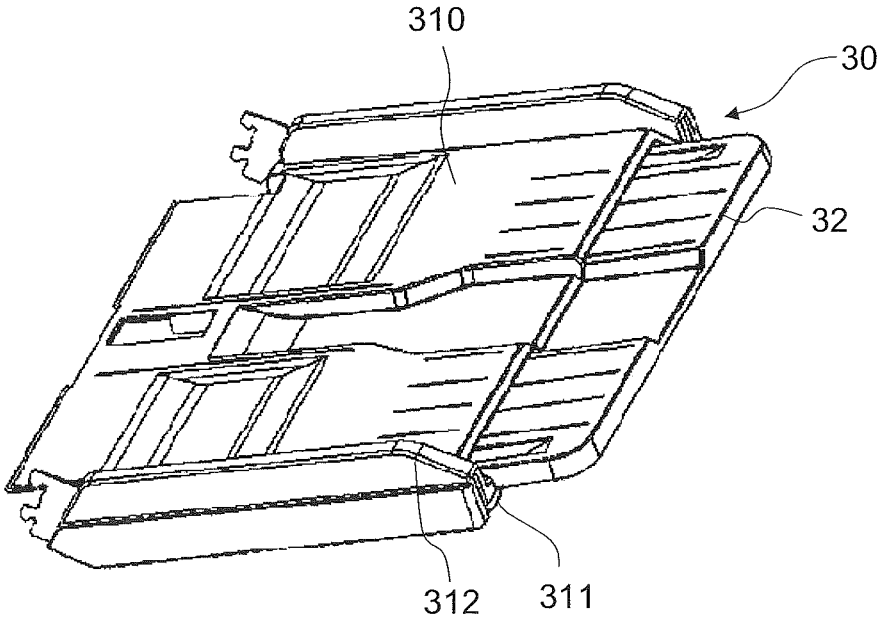
FIG. 3 is a perspective view of the sheet discharge tray as seen from above.

Next, the sheet discharge tray 30 will be described in detail with reference to the relevant drawings. FIG. 2 is a perspective view of the sheet discharge tray 30 attached to the printer 100. FIG. 3 is a perspective view of the sheet discharge tray 30 as seen from above, and FIG. 4 is a perspective view of the sheet discharge tray 30 as seen from below.

Figure 5:
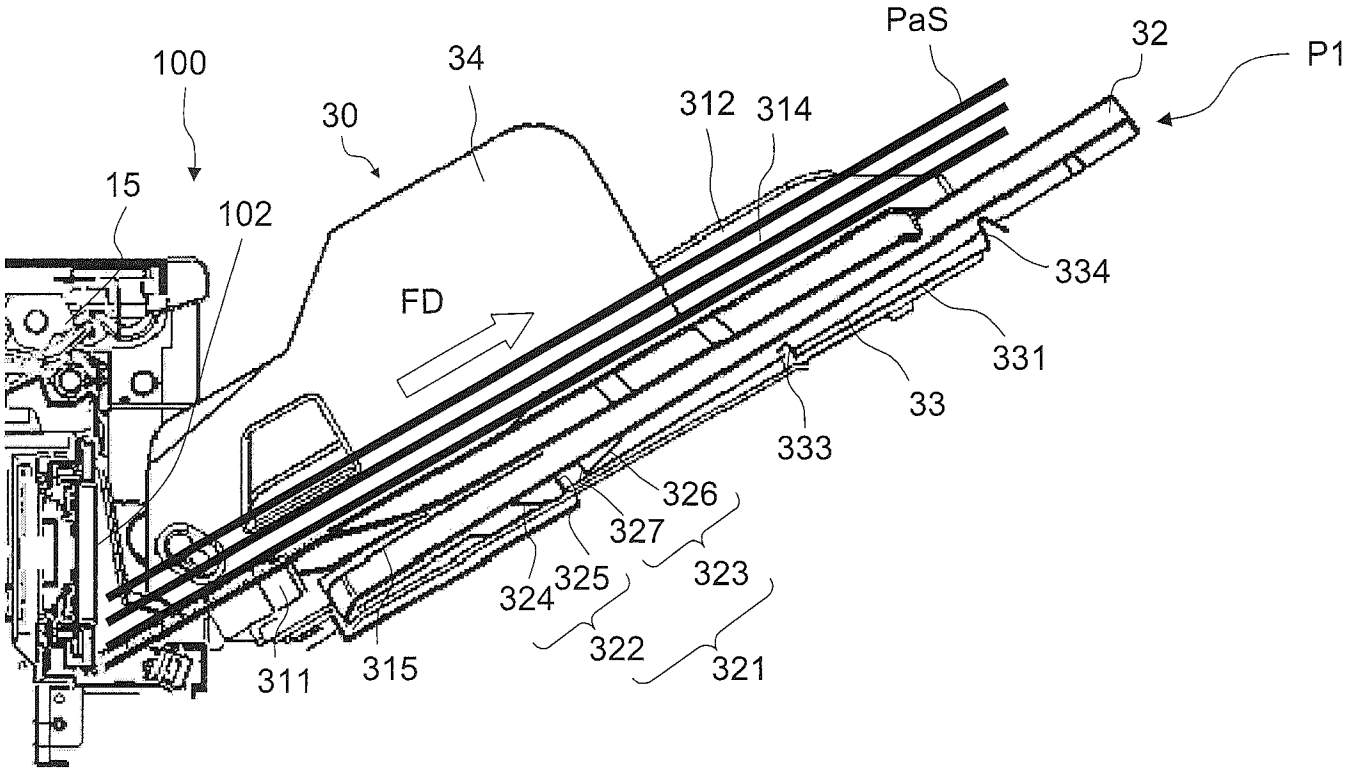
FIG. 5 is sectional view showing a schematic arrangement of the sheet discharge tray accommodating a second tray.
Figure 6:
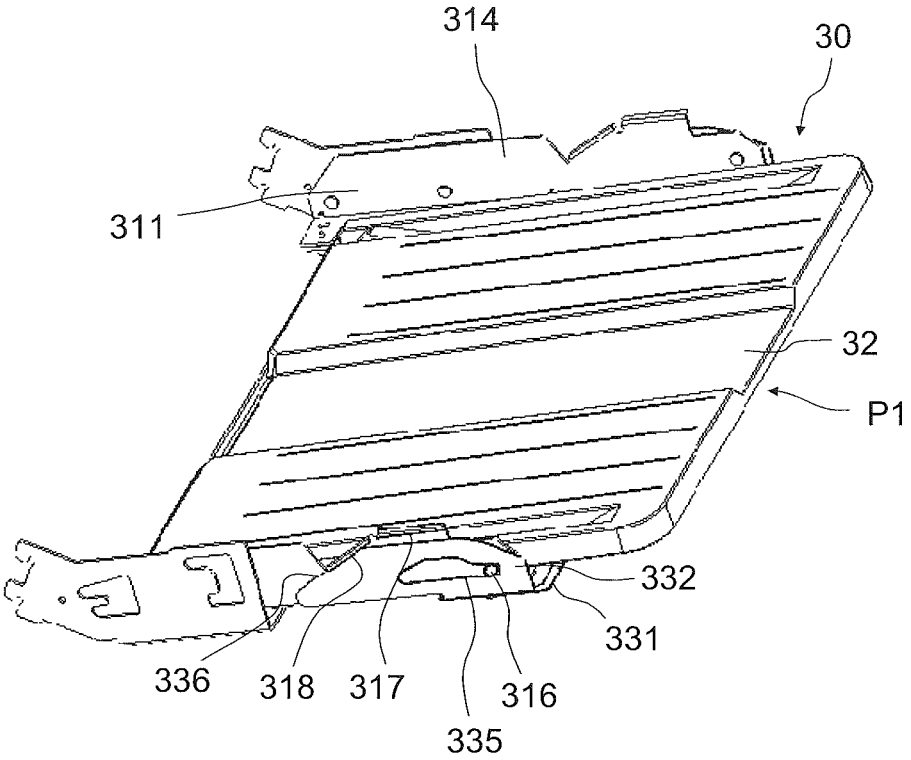
FIG. 6 is a perspective view showing a state with a cover removed from the sheet discharge tray shown in FIG. 5.
Figure 7:
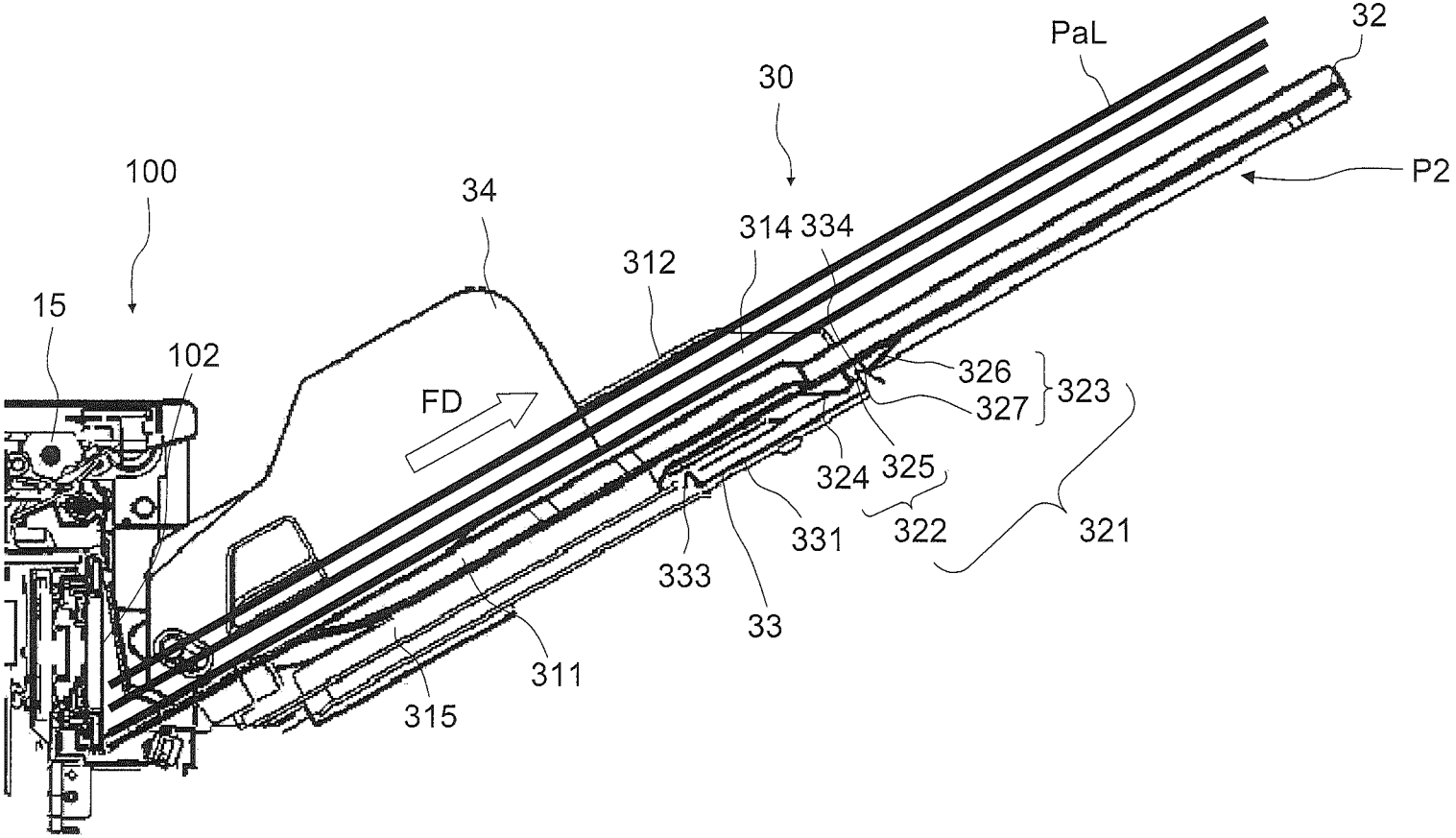
FIG. 7 is a sectional view showing a schematic arrangement of the sheet discharge tray, with the second tray in an extended state.
Figure 8:
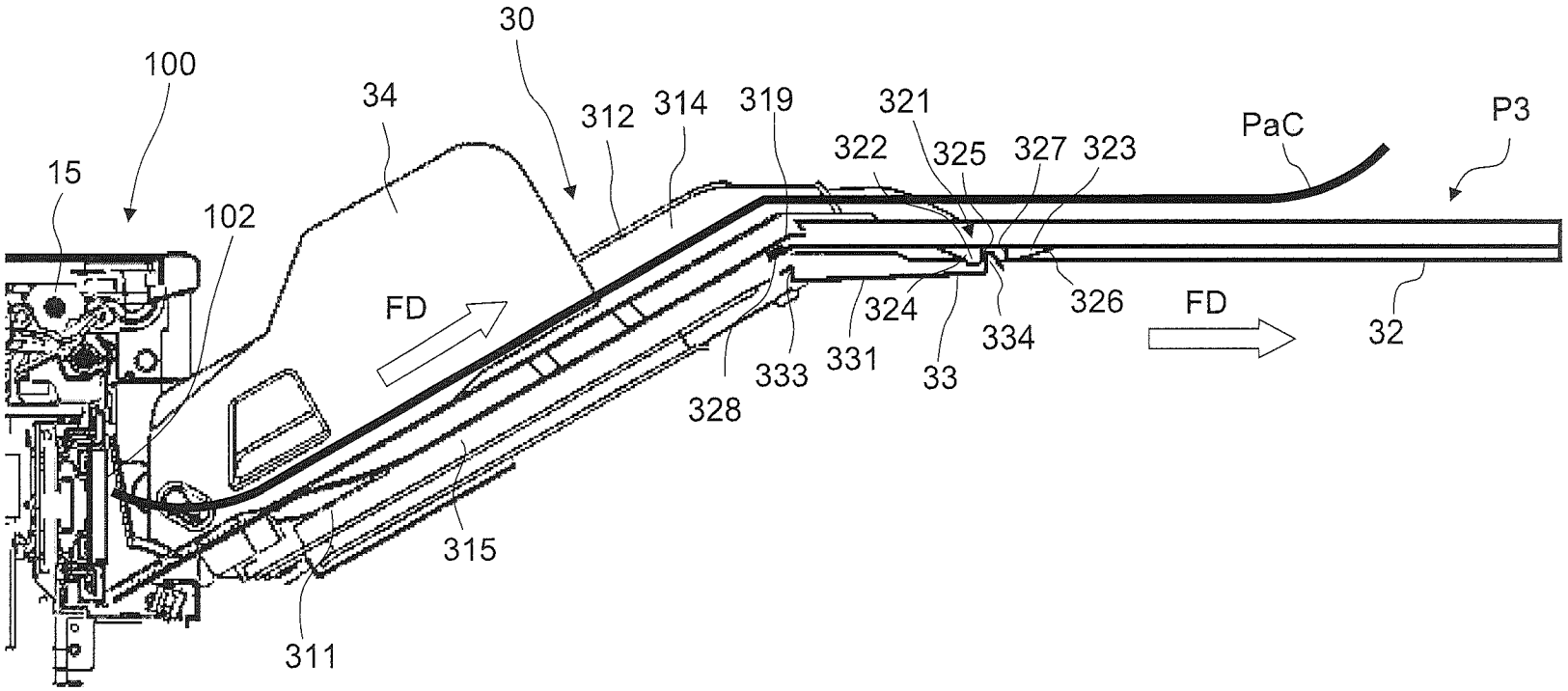
FIG. 8 is a sectional view showing a schematic arrangement of the sheet discharge tray with the second tray, in the extended state, rotated downward.
Figure 9:
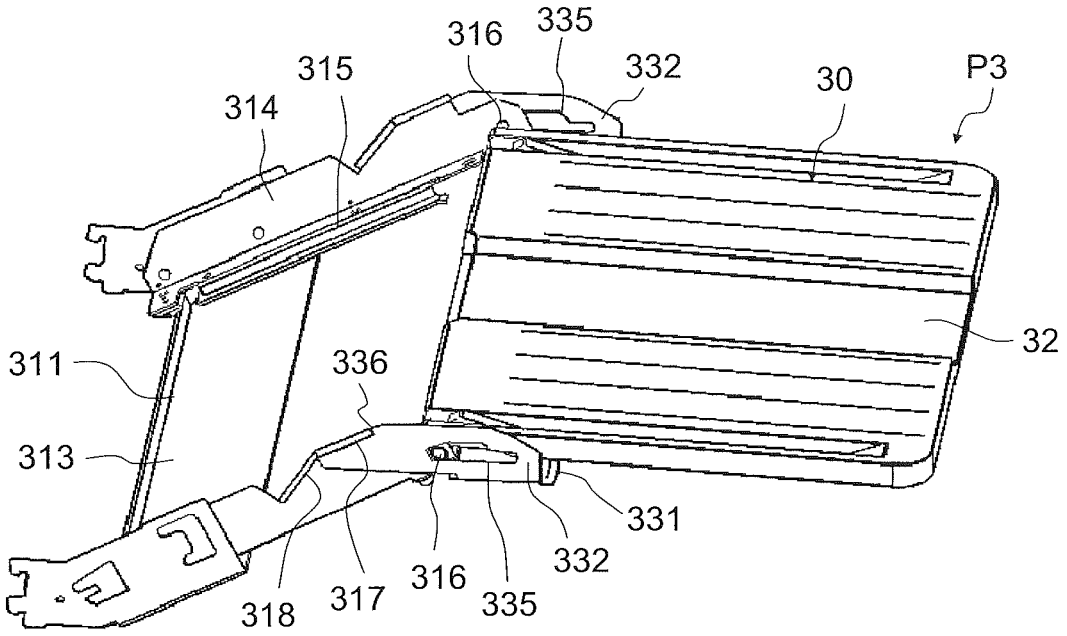
FIG. 9 is a perspective view showing a state with the cover removed from the sheet discharge tray shown in FIG. 5.

FIG. 5 is a sectional view showing a schematic arrangement of the sheet discharge tray 30 accommodating a second tray 32. FIG. 6 is a perspective view showing the sheet discharge tray 30 of FIG. 5 with the first tray 312 removed. FIG. 7 is a sectional view showing a schematic arrangement of the sheet discharge tray 30 with the second tray 32 in an extended state. FIG. 8 is a sectional view showing a schematic arrangement of the sheet discharge tray 30 with the second tray 32, in the extended state, rotated downward. FIG. 9 is a perspective view of the sheet discharge tray 30 of FIG. 8 with the first tray 312 removed. In FIG. 5, FIG. 7, and FIG. 8, though these are sectional views, no hatching is used to indicate sections, because they are all small.

As shown in FIG. 2, the printer 100 includes a housing 101. The housing 101 is a framework that supports the entire printer 100. On a side surface of the housing 101, on an upright wall 102 extending in the vertical direction, the discharge roller pair 15 is arranged. The sheet discharge tray 30 is arranged in contact with the upright wall 102, and is located below the discharge roller pair 15.

Figure 4:
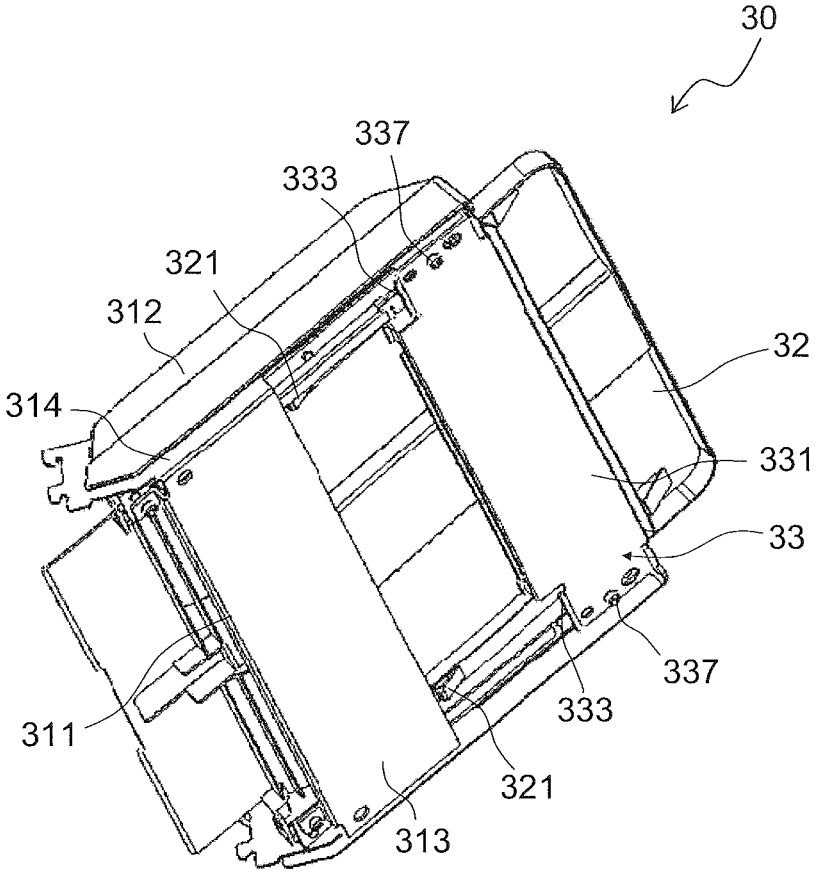
FIG. 4 is a perspective view of the sheet discharge tray as seen from below.

As shown in FIGS. 2 to 4, the sheet discharge tray 30 includes a frame 311, the first tray 312, the second tray 32, an angle switching member 33, and width adjustment cursors 34.

The frame 311 is a metal member formed, for example, by bending a steel sheet. As shown in FIG. 4, the frame 311 includes a bottom portion 313 and a pair of wall portions 314. The bottom portion 313 is a rectangular member. In the sheet discharge tray 30 of the embodiment, the bottom portion 313 has the shape of a rectangular plate of which the longitudinal direction is a direction perpendicular to the sheet discharge direction FD (the longitudinal direction will sometimes be referred to as the width direction in the following description). The pair of wall portions 314 protrude upward from the opposite ends of the bottom portion 313 in the width direction. The bottom portion 313 and the pair of wall portions 314 are fixed together with fixing members such as screws. The bottom portion 313 and the pair of wall portions 314 may instead be an integrally formed body.

As shown in FIGS. 5 to 7, the pair of wall portions 314 extend in the sheet discharge direction FD. The pair of wall portions 314 has rails 315 and support shafts 316. The rails 315 extend in the sheet discharge direction FD, and are open inward in the width direction. The rails 315 are fixed to a lower part of the pair of wall portions 314. The rails 315 guide the second tray 32. The support shafts 316 project outward from the outer surfaces of the pair of wall portions 314. The support shafts 316 penetrate guide holes 335, which are provided in the angle switching member 33 so as to extend in the sheet discharge direction FD. This allows the angle switching member 33 to move along the sheet discharge direction FD. Furthermore, the angle switching member 33 is rotatable about the support shafts 316 when located at the most downstream-side position in the sheet discharge direction FD. Details of the angle switching member 33 will be given later.

As shown in FIG. 6, the each of the pair of wall portions 314 has a first contact surface 317 and a second contact surface 318. The first contact surface 317 is the lower surface of a bent portion formed by outwardly bending an upper end part of each of the pair of wall portions 314. The first contact surface 317 extends along the sheet discharge direction FD. The second contact surface 318 is arranged on the upstream side of the first contact surface 317 in the sheet discharge direction FD. The second contact surface 318 is, like the first contact surface 317, the lower surface of a bent portion formed by bending each of the pair of wall portions 314.

The second contact surface 318 is arranged such that the downstream side in the sheet discharge direction FD is located above the upstream side in the sheet discharge direction FD to be close to the first contact surface 317. That is, the angle of the second contact surface 318 with respect to the horizontal plane is larger than that of the first contact surface 317. With the first and second contact surfaces 317 and 318, a rotation restricting portion 336, which will be described later, of the angle switching member 33 is in contact. Details will be given later of the contact between the first and second contact surfaces 317 and 318 and the rotation restricting portion 336.

The first tray 312 is fixed to the frame 311. The first tray 312 is an exterior member, which covers an upper part of the bottom portion 313 and also covers the inner and outer surfaces of the pair of wall portions 314 in the width direction. With the first tray 312 fixed to the frame 311, the frame 311 is concealed, so that direct contact is prevented between a sheet or a hand of a user and the frame 311. As shown in FIG. 3, the first tray 312 has a stacking surface 310. The stacking surface 310 is arranged above the bottom portion 313. The stacking surface 310 is a surface for receiving a discharged sheet. The width adjustment cursors 34, which have been mentioned previously, are arranged on the stacking surface 310 so as to be movable in the width direction. Furthermore, a gap is formed between the stacking surface 310 and the bottom portion 313. The second tray 32 can be accommodated in this gap.

The frame 311 is attached to the upright wall 102 such that the downstream side in the sheet discharge direction FD is inclined upward. That is, the downstream side of the first tray 312 in the sheet discharge direction FD is inclined upward. A sheet discharged from the discharge roller pair 15, under the self weight, moves across the stacking surface 310 toward the upright wall 102. In this way, printed sheets are laid on one another within a given range, and this contributes to improved user-friendliness.

As shown in FIG. 2, the width adjustment cursors 34 are arranged on the upper side of the stacking surface 310. The width adjustment cursors 34 are flat plate-shaped members, and reciprocate across the upper side of the stacking surface 310 in a direction (here, the width direction) that intersects the sheet discharge direction FD. The width adjustment cursors 34 regulate the positions of the edges of a discharged sheet in the direction perpendicular to the sheet discharge direction FD. That is, the width adjustment cursors 34 guide a discharged sheet. The width adjustment cursors 34 have a configuration that is widely used in conventional sheet discharge trays, and thus in this respect no detailed description will be given.

Next, the second tray 32 will be described in detail. As shown in FIGS. 6 and 8, the second tray 32 is plate-shaped. The second tray 32 is accommodated between the bottom portion 313 and the first tray 312, and is supported on the frame 311 so as to be extendible-retractable between a first position P1 (see FIG. 5 and FIG. 6) at which the second tray 32 is accommodated between the bottom portion 313 and the first tray 312 such that at least part of the second tray 32 overlaps the first tray 312, and a second position P2 (see FIG. 7) to which the second tray 32 is extended by being moved toward the downstream side in the sheet discharge direction FD relative to the first tray 312. The second tray 32 can move also to a third position P3 (see FIG. 8, FIG. 9, etc.) to which the second tray 32 is extended further to the downstream side of the second position P2 in the sheet discharge direction FD, and at the third position P3, the second tray 32 is rotationally movable downward about, as a pivot, the upstream side in the sheet discharge direction FD. The third position P3 is a position where an upstream-side end part of the first tray 312 in the sheet discharge direction FD reaches a downstream-side end part of the frame 311 in the sheet discharge direction FD.

The second tray 32 includes an engaging portion 321 which protrudes downward from the lower surface. The engaging portion 321 includes a first projection 322 and a second projection 323. The first and second projections 322 and 323 are arranged side by side in the sheet discharge direction FD. The engaging portion 321 will now be described with reference to another few figures. FIGS. 10 to 18 are schematic diagrams showing engagement between the engaging portion 321 and a first engaged portion 333 or a second engaged portion 334, the latter being provided on the angle switching member 33. Here, the sheet discharge direction FD indicated in FIGS. 10 to 18 is the direction in which a sheet P moves on the second tray 32.

Figure 10:
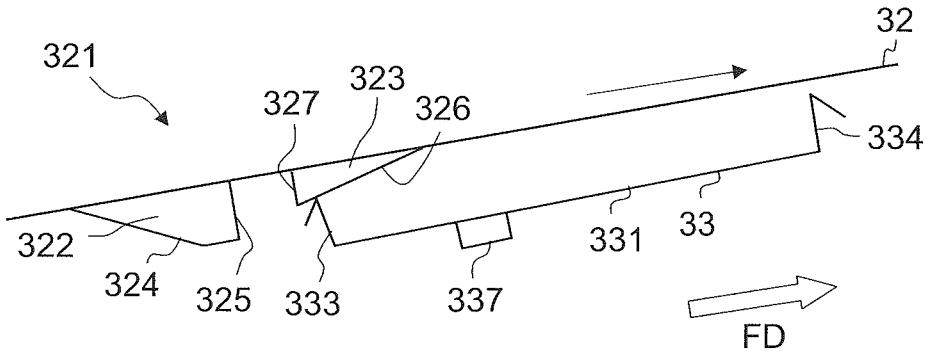
FIG. 10 is a schematic diagram showing movement of an engaging portion in a state with the engaging portion unengaged with an engaged portion.

As shown, for example, in FIG. 10, the first projection 322 includes a first inclined surface 324 of which the downstream side in the sheet discharge direction FD is away from the lower surface of the second tray 32, and a first engagement surface 325 which is arranged on the downstream side of the first inclined surface 324 and which stands upright from the lower surface of the second tray 32. Here, the first engagement surface 325 standing upright denotes not only its being perpendicular to the lower surface of the second tray 32 but also its being slightly deviated from being so. In other words, the first engagement surface 325 standing upright from the lower surface of the second tray 32 means that the first engagement surface 325 is formed at such an angle that it can engage with the first and second engaged portions 333 and 334, which will be described later, provided on the angle switching member 33.

The second projection 323 includes a second inclined surface 326 of which the upstream side in the sheet discharge direction FD is away from the lower surface of the second tray 32, and a second engagement surface 327 which is arranged on the upstream side of the second inclined surface 326 and which stands upright from the lower surface of the second tray 32. Here, what is meant by "standing upright" is the same as above.

In the engaging portion 321, the first and second engagement surfaces 325 and 327 are arranged to face each other across a gap between them in the sheet discharge direction FD. That is, the first engagement surface 325 points toward the downstream side in the sheet discharge direction FD, and the second engagement surface 327 points toward the upstream side in the sheet discharge direction FD. Here, the upright length of the first engagement surface 325 from the bottom surface of the second tray 32 is greater than that of the second engagement surface 327 from the lower surface of the second tray 32. This, however, is not meant as any limitation. For example, the upright length of the first engagement surface 325 from the lower surface of the second tray 32 may be equal to that of the second engagement surface 327 from the lower surface of the second tray 32.

The second tray 32 is guided by the rails 315 provided on the frame 311. When the second tray 32 is at the third position P3, the second tray 32 is rotatable relative to the frame 311, that is, relative to the frame 311. At this time, the angle switching member 33 supports the second tray 32, and the second tray 32 stops at a given angle relative to the first tray 312. Thus, the angle of the second tray 32 relative to the first tray 312 can be changed by the angle switching member 33.

Next, the angle switching member 33 will be described. The angle switching member 33 is formed by cutting and bending a metal sheet by pressing or the like. The angle switching member 33 does not necessarily have to be integrally formed by pressing, but may instead be formed by combining together a plurality of members. The angle switching member 33 rotates in coordination with the second tray 32 when the second tray 32 rotationally moves, and when the second tray 32 reaches a predetermined angle relative to the first tray 312, the angle switching member 33 restricts the rotation of the second tray 32.

As shown in FIGS. 4, 6, 9, etc., the angle switching member 33 includes a flat-plate portion 331 and a pair of guide wall portions 332. The flat-plate portion 331 is rectangular in a plan view, and is arranged such that its longitudinal direction is perpendicular to the sheet discharge direction FD. The opposite ends of the flat-plate portion 331 in the width direction are connected to the pair of guide wall portions 332. The pair of guide wall portions 332 have the shape of plates extending in the sheet discharge direction FD. The pair of guide wall portions 332 are provided in a pair in opposite end parts of the flat-plate portion 331 in the width direction so as to face each other in the width direction. The flat-plate portion 331 is provided with the first engaged portion 333 and the second engaged portion 334.

For example, as shown in FIGS. 5, 10, etc., the first and second engaged portions 333 and 334 extend upward from opposite end portions of the flat-plate portion 331 in the sheet discharge direction FD. The first and second engaged portions 333 and 334 are elastically deformable. The first engaged portion 333 has an upper edge part of it bent toward the upstream side in the sheet discharge direction FD. The second engaged portion 334 has an upper edge part of it bent toward the downstream side in the sheet discharge direction FD.

The pair of guide wall portions 332 is provided with the guide holes 335, which extend in the sheet discharge direction FD and which penetrate the guide wall portions 332 in the direction perpendicular to the sheet discharge direction FD. The guide holes 335 are penetrated by the support shafts 316, which protrude from the frame 311. Here, the support shafts 316 may be provided, at the protrusion end side, with a retaining portion which has a larger diameter than at the protrusion base side. The angle switching member 33 is movable in the sheet discharge direction FD relative to the frame 311. When the angle switching member 33 moves, the support shafts 316 move in the guide holes 335 in relative terms. In other words, the contact between the guide holes 335 and the support shaft 316 guides the movement of the angle switching member 33.

The pair of guide wall portions 332 is provided, at the upstream side of an upper end part in the sheet discharge direction FD, with the rotation restricting portion 336. When the angle switching member 33 is at the most upstream-side end in the sheet discharge direction FD, the rotation restricting portion 336 is in contact with the second contact surface 318. This restricts the movement of the angle switching member 33 toward the upstream side in the sheet discharge direction FD. When the angle switching member 33 has moved to the most downstream-side position in the sheet discharge direction FD, the support shaft 316 is located at a most downstream part of the guide hole 335 in the sheet discharge direction FD. In this state, the downstream side of the angle switching member 33 is swingable downward. Then, after the angle switching member 33 rotates, the rotation restricting portion 336 comes into contact with the first contact surface 317, and this restricts the rotation of the angle switching member 33.

The flat-plate portion 331 is provided with an engagement adjustment member 337. The engagement adjustment member 337 is provided at opposite end parts of the flat-plate portion 331 in the width direction. The engagement adjustment member 337 is provided with a screw, which is inserted into a female screw hole provided in the flat-plate portion 331 from below to be meshed with it. As a result, the tip end of the engagement adjustment member 337 makes contact with the lower surface of the rails 315. For example, moving the engagement adjustment member 337 upward causes the upper end part of the first engaged portion 333 to move away from the lower surface of the second tray 32. Thereby, the engagement state between the engaging portion 321 and the first engaged portion 333 is changed. Details of how to operate the engagement adjustment member 337 will be given later.

Next, a description will be given of the movement of the second tray 32 in the sheet discharge tray 30. As mentioned previously, the second tray 32 can move between the first position P1, where it is accommodated between the frame 311 and the first tray 312, and the second position P2, to which it is pulled out of the first tray 312 toward the downstream side in the sheet discharge direction FD. The second tray 32 is so arranged that, at least so long as it is located between the first and second positions P1 and P2, its opposite ends in the width direction are slidable inside the rails 315 provided on the frame 311. That is, the second tray 32 can reciprocate between the first and second positions P1 and P2 while being guided by the rails 315.

As shown in FIG. 5, when the second tray 32 is at the first position P1, the engaging portion 321 of the second tray 32 does not engage with either of the first and second engaged portions 333 and 334 of the angle switching member 33. That is, when the second tray 32 is at the first position P1, the second tray 32 is not engaged with the angle switching member 33. As shown in FIG. 10, when the second tray 32 is moved toward the downstream side in the sheet discharge direction FD and has moved over a predetermined distance, the second inclined surface 326 of the engaging portion 321 makes contact with the first engaged portion 333. When the second tray 32 is pulled out farther toward the downstream side in the sheet discharge direction FD, the first engaged portion 333 is pushed by the second inclined surface 326, and the upper side elastically deforms toward the downstream side in the sheet discharge direction FD about, as a pivot, the part connecting to the flat-plate portion 331, so that it, while sliding across the second inclined surface 326, passes over the second projection 323.

The frame 311 is so inclined that its downstream side in the sheet discharge direction FD points upward. When the second tray 32 is extended toward the downstream side in the sheet discharge direction FD, the angle switching member 33 is, at the upstream side in the sheet discharge direction, acted on by a force due to the self weight. The distance between the upper end of the first engaged portion 333 and the lower surface of the second tray 32 can be adjusted by the engagement adjustment member 337. In the state shown in FIG. 10, the engagement adjustment member 337 sets the distance between the upper end of the first engaged portion 333 and the lower surface of the second tray 32 to be such a length that, when the second tray 32 is moved toward the downstream side in the sheet discharge direction FD, the first engaged portion 333 can pass over the first projection 322.

Figure 11:
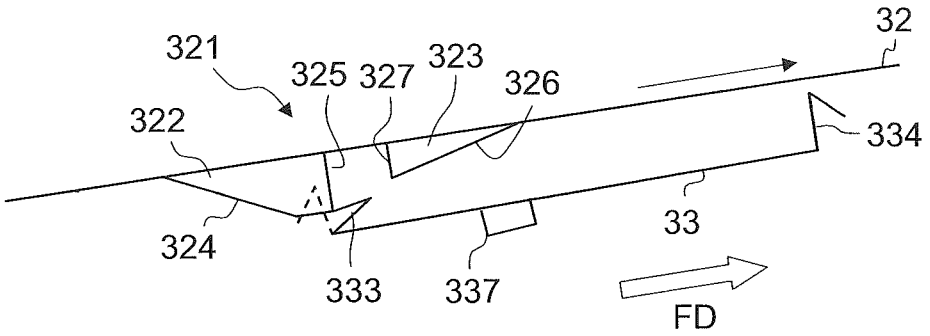
FIG. 11 is a schematic diagram showing how a first engaged portion passes over a first projection when the second tray moves to a second position.
Figure 12:
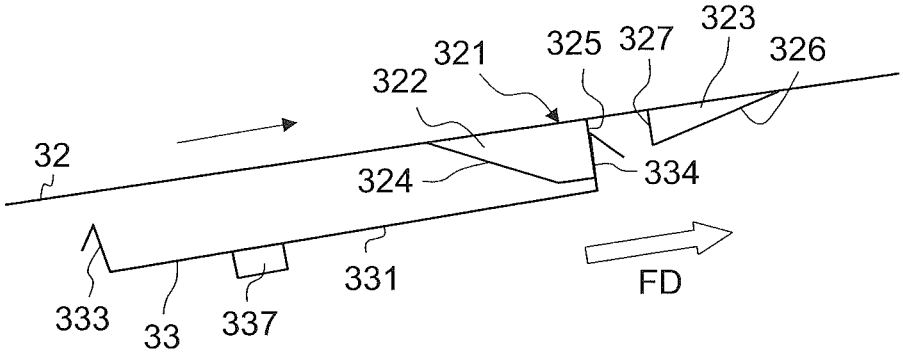
FIG. 12 is a schematic diagram showing a state with a first engagement surface in engagement with a second engaged portion.
Figure 13:
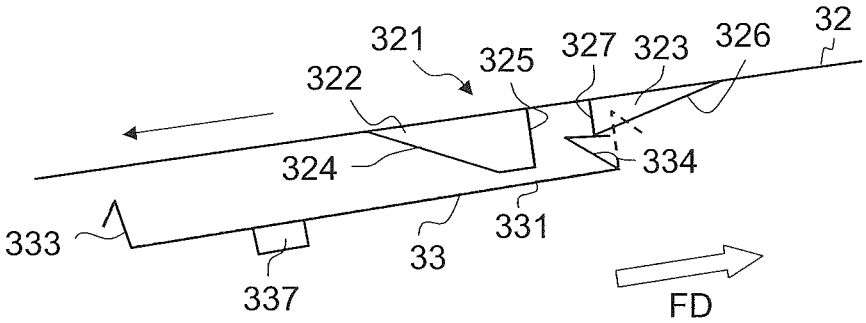
FIG. 13 is a schematic diagram showing how the second engaged portion passes over a second projection when the second tray moves back to a first position.
Figure 14:
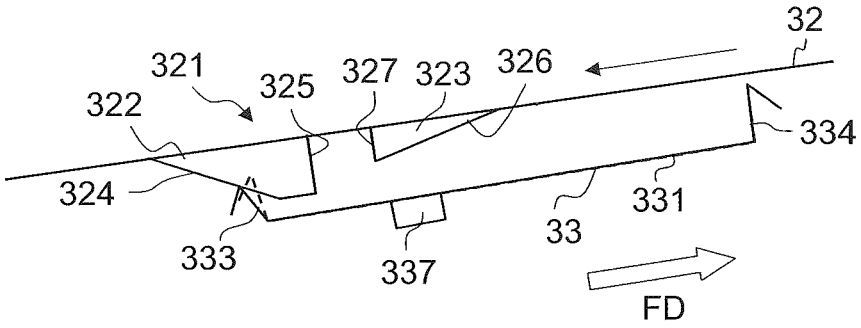
FIG. 14 is a schematic diagram showing how the first engaged portion passes over the first projection when the second tray moves back to the first position.
Figure 15:
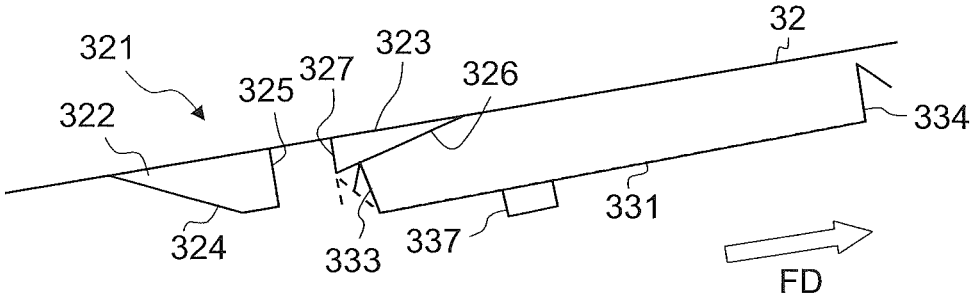
FIG. 15 is a schematic diagram showing how the first engaged portion passes over the second projection when the second tray moves back to the first position.

Accordingly, as shown in FIG. 11, when the second tray 32 is pulled out farther toward the downstream side in the sheet discharge direction FD, the first engaged portion 333 makes contact with the first engagement surface 325. The first engaged portion 333 is pushed by the first engagement surface 325, and the upstream side elastically deforms toward the downstream side in the sheet discharge direction FD about, as a pivot, the part connecting to the flat-plate portion 331, so that it passes over the first projection 322. Then, as shown in FIG. 12, the second tray 32 reaches the second position P2, and the first engagement surface 325 engages with the second engaged portion 334. When the second tray 32 is at the second position P2, the sheet discharge tray 30 can receive a sheet that is long in the sheet discharge direction FD.

As shown in FIG. 12 etc., the distance between the upper end of the second engaged portion 334 and the lower surface of the second tray 32 is shorter than the distance between the upper end of the first engaged portion 333 and the lower surface of the second tray 32. The distance between the upper end of the second engaged portion 334 and the lower surface of the second tray 32 is adjusted to be such a length that the second projection 323 can be passed over but the first projection 322 cannot be passed over. More specifically, the distance between the upper end of the second engaged portion 334 and the lower surface of the second tray 32 is such as to counter the force acting on the upstream side in the sheet discharge direction FD along the rails 315 due to the self weight of the second tray 32. The distance between the upper end of the second engaged portion 334 and the lower surface of the second tray 32 is such a length that, when a given force is additionally applied toward the upstream side in the sheet discharge direction FD, the second engaged portion 334 can pass over the second projection 323.

When the second tray 32 is at the second position P2, end parts of the second tray 32 in the width direction are located inside the rails 315. This restricts the movement of the second tray 32 in the up-down direction, that is, the movement (rotation) of the downstream side in the sheet discharge direction FD. Moreover, when the second tray 32 is at the second position P2, the second tray 32 is, at the upstream side in the sheet discharge direction FD, acted on by a force along the rails 315 owing to the self weight.

As a result, the second engagement surface 327 pushes the second engaged portion 334 toward the upstream side in the sheet discharge direction FD. At this time, the rotation restricting portion 336 of the angle switching member 33 is in contact with the second contact surface 318, and the movement of the angle switching member 33 toward the upstream side is restricted. Thus, the engagement of the second engaged portion 334 with the second engagement surface 327 restricts the backward movement of the second tray 32 toward the first position P1.

Next, a description will be given of how the second tray 32 is moved back to the first position P1. As shown in FIGS. 7 and 12, when the second tray 32 is at the second position P2, the second engagement surface 327 of the engaging portion 321 is in contact with the second engaged portion 334. In this state, when a force that tends to move the second tray 32 toward the upstream side in the sheet discharge direction FD is applied, the second engaged portion 334 is pushed by the second engagement surface 327. When the force pushing the second tray 32 becomes equal to or stronger than a predetermined force, the second engaged portion 334 deforms, at the upstream side in the sheet discharge direction FD, about the part connecting to the flat-plate portion 331 toward the upstream side, and passes over the second projection 323 (see FIG. 13).

When the second tray 32 moves farther, the first engaged portion 333 makes contact with the first inclined surface 324. At this time, the angle switching member 33 is restrained from moving toward the upstream side in the sheet discharge direction FD. Thus, the first engaged portion 333 is pushed by the first inclined surface 324, and elastically deforms, at the upper side, toward the upstream side in the sheet discharge direction FD about, as a pivot, the part connecting to the flat-plate portion 331, and passes over the first projection 322 (see FIG. 14).

The second engagement surface 327 of the second projection 323 makes contact with the first engaged portion 333. When a force that tends to move the second tray 32 toward the upstream side in the sheet discharge direction FD is applied, the first engaged portion 333 is pushed by the second engagement surface 327. Thus, the first engaged portion 333 elastically deforms, at the upper side, toward the upstream side in the sheet discharge direction FD about, as a pivot, the part connecting to the flat-plate portion 331, and passes over the first projection 322 (see FIG. 15). Thus, the second tray 32 disengages from the angle switching member 33. Then the second tray 32 is moved toward the upstream side in the sheet discharge direction FD, and the second tray 32 moves back to the first position P1.

Next, a description will be given of a case where the second tray 32 is bent with respect to the first tray 312. How the second tray 32 moves from the first position P1 to the second position P2 is the same as described above, and therefore no detailed description will be repeated. The second tray 32 can be pulled out farther beyond the second position P2 toward the upstream side in the sheet discharge direction FD.

When the second tray 32 is at the second position P2, the second engaged portion 334 is in contact with the first engagement surface 325 (see FIG. 12). As mentioned previously, the second engaged portion 334 is so arranged as not to pass over the first projection 322, which includes the first engagement surface 325. Thus, when the second tray 32 at the second position P2 is biased further toward the downstream side in the sheet discharge direction FD, the second engaged portion 334 is pushed by the first engagement surface 325. Here, the angle switching member 33 can move toward the downstream side in the sheet discharge direction FD. Accordingly, the angle switching member 33 moves, along with the second tray 32, toward the downstream side in the sheet discharge direction FD.

At that time, the support shaft 316 moves in the guide hole 335. The support shaft 316 then makes contact with an end part of the guide hole 335 on the upstream side in the sheet discharge direction FD, and this restricts the movement of the angle switching member 33 toward the downstream side in sheet discharge direction FD. As a result of the movement of the angle switching member 33 toward the downstream side in sheet discharge direction FD being limited, also the movement of the second tray 32 toward the downstream side in the sheet discharge direction FD is restricted. The position at which the movement of the second tray 32 is restricted is referred to as the third position P3. At the third position P3, opposite end parts of the second tray 32 in the width direction are located away from the rail 315.

Figure 16:
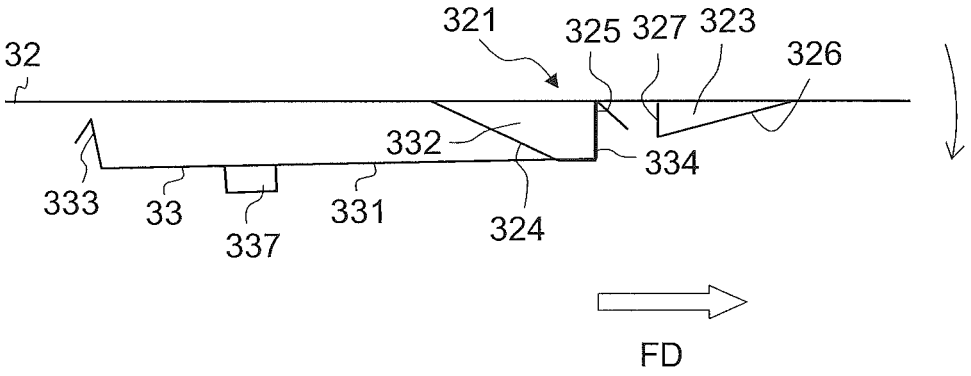
FIG. 16 is a diagram showing an engaging portion and an engaged portion with the second tray 2 moved to a third position.
Figure 17:
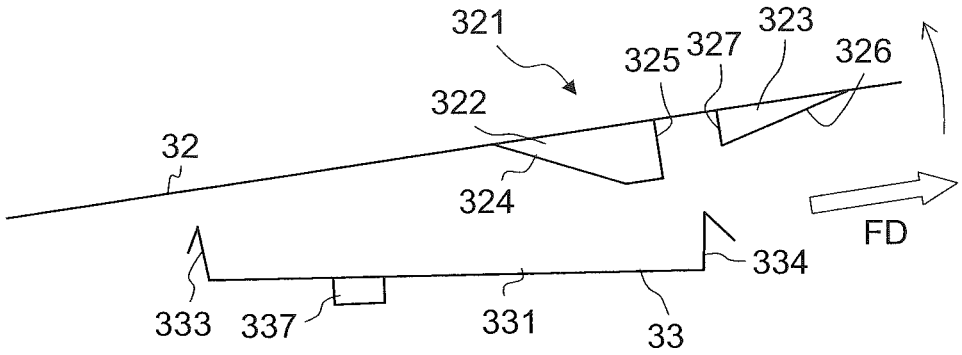
FIG. 17 is a schematic diagram showing a state of the engaging portion and the engaged portion with the second tray, at the third position, raised.
Figure 18:
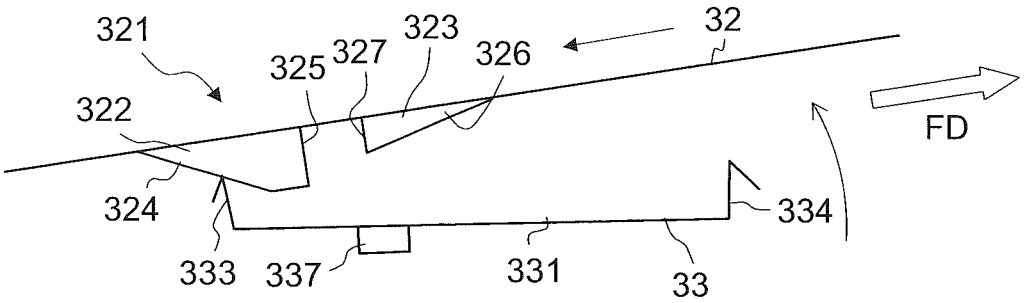
FIG. 18 is a schematic diagram showing a state of the engaging portion and the engaged portion when the second tray moves from the third position to the second position.

As shown in FIG. 16, the downstream side of the second tray 32 in the sheet discharge direction FD rotates downward about, as a pivot, the upstream side of it in the sheet discharge direction FD. Moreover, its rotation from the frame 311 with respect to the angle switching member 33 is no longer restricted. Thus, along with the second tray 32, the downstream side of the angle switching member 33 in the sheet discharge direction FD rotates downward about the support shaft 316. Then the rotation restricting portion 336 of the angle switching member 33 makes contact with the first contact surface 317, and thereby restricts the rotation of the angle switching member 33.

At that time, the second engaged portion 334 is located between the first and second projections 322 and 323. The angle switching member 33 is arranged on the lower surface of the second tray 32, and does not restrict the upward movement of the second tray 32. Thus, when the upper surface of the second tray 32 becomes level with the horizontal plane, the upper surface of an end part of the second tray 32 on the upstream side in the sheet discharge direction FD makes contact with an end part 319 of the first tray 312 on the downstream side in the sheet discharge direction FD. This restricts further rotation of the downstream side of the second tray 32 in the sheet discharge direction FD (see FIG. 8).

The angle switching member 33 engages with the engaging portion 321 provided on the lower surface of the second tray 32. Thus, when the downstream side, in the sheet discharge direction FD, of the second tray 32 at the third position P3 rotates downward, the downstream side, in the sheet discharge direction FD, of the second tray 32 relative to the center of rotation on its lower surface makes contact with the angle switching member 33, the rotation is restricted (see FIG. 16).

When the second tray 32 is at the third position P3, part of the second tray 32 may be located on the rail 315. Here, an end part of the rail 315 on the downstream side in the sheet discharge direction FD may be given such a shape that it, when the second tray 32 rotates through a predetermined angle, makes contact with the upper surface of an end part of the second tray 32 on the upstream side in the sheet discharge direction FD, so that it restricts the rotation of the downstream side of the second tray 32 in the sheet discharge direction FD.

Next, a description will be given of a case where the second tray 32 in the horizontal state is moved back to the second position P2. When the second tray 32 in the horizontal state is moved back to the original position, first, the downstream side of the second tray 32 in the sheet discharge direction FD is raised. At this time, the engaging portion 321 of the second tray 32 move, in the up-down direction, away from the first and second engaged portions 333 and 334 of the angle switching member 33 (see FIG. 17). Then, opposite end parts of the second tray 32 in the width direction are raised up to an angle at which they align with the rails 315, and then the second tray 32 is moved along the rails 315. When the second tray 32 moves a predetermined distance, the first inclined surface 324 of the second tray 32 makes contact with the first engaged portion 333 of the angle switching member 33. At this time, the angle switching member 33 is in a horizontal state, and the second tray 32 is inclined with respect to the angle switching member 33.

When the second tray 32 moves along the rails 315, the first inclined surface 324 pushes the first engaged portion 333. An upper end part of the first engaged portion 333 is pushed by the first inclined surface 324, with the result that the upper end part of the first engaged portion 333 is acted on by a force pointing to the upstream side in the sheet discharge direction FD. This force causes the downstream side of the angle switching member 33 in the sheet discharge direction FD to rotate upward (see FIG. 18). When it rotates through a predetermined angle, the engagement adjustment member 337 makes contact with the lower surface of the rails 315. Thus, the angle switching member 33 moves to a position along the rails 315, that is, the frame 311.

When the second tray 32 moves toward the upstream side in the sheet discharge direction FD, the first engaged portion 333 is pushed by the first inclined surface 324. Under the force from the first inclined surface 324, the upper side of the first engaged portion 333 elastically deforms, about a part of it connected to the flat-plate portion 331, toward the upstream side in the sheet discharge direction FD, and passes over the first projection 322. Then the first engaged portion 333 makes contact with the second engagement surface 327. When the second tray 32 moves toward the upstream side in the sheet discharge direction FD, the first engaged portion 333 is pushed by the second engagement surface 327 (see FIG. 15), and the angle switching member 33 moves along with the second tray 32.

Since the second engagement surface 327 is a surface that stands upright from the lower surface of the second tray 32, the force that acts on the first engaged portion 333 from the second engagement surface 327 points toward the upstream side in the sheet discharge direction FD along the frame 311. Since the frame 311 is inclined, the movement of the angle switching member 33 toward the upstream side in the sheet discharge direction FD is in the same direction in which a gravitational force acts. Accordingly, the movement of the angle switching member 33 toward the upstream side in the sheet discharge direction FD can be achieved with a weak force. Thus, before the upper side of the first engaged portion 333 elastically deforms, about the part of it connecting to the flat-plate portion 331, toward the upstream side in the sheet discharge direction FD and the force for passing over the second projection 323 acts, the angle switching member 33 moves toward the upstream side in the sheet discharge direction FD. Here, depending on the distance between the first engaged portion 333 and the lower surface, the first engaged portion 333 may be pushed by the first inclined surface 324.

When the angle switching member 33 moves over a predetermined distance, the rotation restricting portion 336 of the angle switching member 33 makes contact with the second contact surface 318. This limits the movement of the angle switching member 33 toward the upstream side in the sheet discharge direction FD. The arrangement here is such that the movement of the angle switching member 33 is restricted by the rotation restricting portion 336 making contact with the second contact surface 318. This, however, is not meant as any limitation; the movement may be restricted by the support shaft 316 making contact with an end part of the guide hole 335 on the downstream side in the sheet discharge direction FD. The two arrangements may be adopted in combination.

As a result of the movement of the angle switching member 33 toward the upstream side in the sheet discharge direction FD being restricted, the first engaged portion 333 is pushed by the second engagement surface 327, and the upper side of the first engaged portion 333 elastically deforms, about the part of it connecting to the flat-plate portion 331, toward the upstream side in the sheet discharge direction FD, so that the first engaged portion 333 passes over the second projection 323. Thus, the engaging portion 321 disengages from the first engaged portion 333. That is, the second tray 32 separates from the angle switching member 33 and moves up to the first position P1. When the first engaged portion 333 moves as a result of being pushed by the first inclined surface 324, the first engaged portion 333 passes over the first and second projections 322 and 323 one after the other.

The angle switching member 33 described above is provided with the engagement adjustment member 337. The engagement adjustment member 337 includes a screw that is meshed with the flat-plate portion 331, and the point of the screw makes contact with the lower surface of the rail 315. Adjusting the amount of protrusion of the screw permits adjustment of the distance between the flat-plate portion 331 and the lower surface of the second tray 32. For example, tightening the screw increases the length over which the engagement adjustment member 337 protrudes from the flat-plate portion 331, and causes the flat-plate portion 331 to separate from the lower surface of the second tray 32. This makes it easier for the first and second engaged portions 333 and 334 to pass over the first and second projections 322 and 323. On the other hand, loosening the screw in the engagement adjustment member 337 reduces the length over which the engagement adjustment member 337 protrudes from the flat-plate portion 331, and causes the flat-plate portion 331 to move closer to the lower surface of the second tray 32. This inhibits the first and second engaged portions 333 and 334 from passing over the first and second projections 322 and 323. By operating the engagement adjustment member 337 in the manner described above, it is possible to restrict (inhibit) the movement of the second tray 32 to the third position P3, where it is in a horizontal state.

Adjustment using the engagement adjustment member 337 may be done manually by a user, or may be performed by a control portion (unillustrated) of the printer 100 controlling a driving mechanism (unillustrated). In that case, for example, adjustment can be performed automatically when a sheet is likely to develop a curl.

A description will now be given of how to use the sheet discharge tray 30 which, as described above, can perform sheet discharge with the second tray 32, which protrudes toward the downstream side in the sheet discharge direction FD, bent toward the first tray 312. The printer 100 allows use of a plurality of sheets in a plurality of different sizes; it allows, whenever possible, printing on sheets in different orientations. With a sheet that is short or that is discharged in the direction of its shorter sides (hereinafter referred to as "sheet PaS"), the sheet discharge tray 30 simply needs to be long enough to receive the sheet. Accordingly, in the sheet discharge tray 30, when a short or laterally-fed sheet PaS is discharged, the second tray 32 is retracted into the first tray 312. That is, when the second tray 32 is at the first position. P1, the actual length of the sheet discharge tray 30 in the sheet discharge direction FD is roughly equal to that of the first tray 312.

On the other hand, with a sheet that is long in the sheet discharge direction FD (hereinafter referred to as "sheet PaL"), the sheet discharge tray 30, if its length is equal to that of the first tray 312, cannot receive the entire sheet. To cope with this, in the sheet discharge tray 30, the second tray 32 is pulled out toward the downstream side in the sheet discharge direction FD and is moved to the second position P2. In this state, the sheet PaL is discharged. In this way, even when a sheet PaL that is long in the sheet discharge direction FD is discharged, it can be held securely on the sheet discharge tray 30.

In an inkjet printer like the printer 100, depending on the type of sheet and the amount of ink ejected on, part or the whole of a sheet may curl. For example, with a sheet that has a small area or a sheet that is printed laterally, that is, with a sheet that is short in the sheet discharge direction FD, the degree of curl that it develops when discharged on the sheet discharge tray 30 is low at the upstream and downstream sides in the sheet discharge direction FD. Accordingly, even when a sheet is discharged on top of a curled sheet, the former is less likely to make contact with the curled part or bend. Thus, with a sheet that is short in the sheet discharge direction FD or a laterally-fed sheet, only the first tray 312 can be used, that is, the second tray 32 may be retracted into the first tray.

On the other hand, with a sheet that is long in the sheet discharge direction FD, the degree of curl at the upstream and downstream sides in the sheet discharge direction FD is high. Under the self weight, an end part of it on the upstream side in the sheet discharge direction FD moves across the sheet discharge tray 30 toward the upstream side in the sheet discharge direction FD. Meanwhile, if the sheet is curled upward, the curled sheet is brought up along the upright wall 102; this results in a higher degree of curl in the end part on the upstream side in the sheet discharge direction FD, the curl even causing the end part of the sheet to round.

Thus, the curl in a sheet can be so large as to cause an end part of it to round. If sheets continue to be discharged under such a condition, a sheet is discharged on top of a curled and thereby rounded sheet, possibly leading to inconveniences such as an end part of the sheet bending or warping.

The sheet discharge tray 30 is so inclined that its downstream side in the sheet discharge direction FD points upward. Accordingly, if an end part on the downstream side in the sheet discharge direction FD is curled upward, the self weight worsen the curl, and the curl may cause the end part in the downstream side in the sheet discharge direction FD to round. IN that case, the sheet discharged from the discharge roller pair 15, before being discharged completely, makes contact with the curled part of the sheet placed on the sheet discharge tray 30. If this is repeated, a sheet may fail to be accommodated in the sheet discharge tray 30, or a sheet may be hindered from being discharged and cause a sheet jam.

To cope with that, in the sheet discharge tray 30, when a sheet that is long in the sheet discharge direction FD and that is likely to develop a curl (hereinafter "sheet PaC") is received, the second tray 32 is pulled out from between the frame 311 and the first tray 312, and in addition the downstream side of the second tray 32 in the sheet discharge direction FD is rotated (bent) downward to receive the sheet.

As described above, as a result of the downstream side of the second tray 32 in the sheet discharge direction FD rotating downward, the second tray 32 bends with respect to the first tray 312. Specifically, the sheet discharge tray 30 bends in a middle part of it in the sheet discharge direction FD. When a sheet PaC is discharged on the sheet discharge tray 30 so bend in the middle part, an end part of the sheet PaC on the downstream side in the sheet discharge direction FD is placed on the second tray 32, and an end part of it on the upstream side is placed on the first tray 312.

The second tray 32 has a smaller inclination angle with respect to the horizontal plane than the first tray 312. In the sheet discharge tray 30 of the embodiment, the second tray 32 has its upper surface, on which sheets are stacked, horizontal or substantially horizontal. This, however, is not meant as any limitation; any structure with a smaller inclination angle with respect to the horizontal plane than the first tray 312 may be adopted. In a case where the downstream side of the second tray 32 in the sheet discharge direction FD is located below the upstream side of it, the angle of the second tray 32 with respect to the horizontal plane may be larger than the angle of the first tray 312 with respect to the horizontal plane.

The part of the sheet PaC placed on the first tray 312 is, under the self weight, acted on a force that points across the first tray 312 toward the upstream side in the sheet discharge direction FD. On the other hand, the part place on the second tray 32 is not acted on a force that points toward the upstream side in the sheet discharge direction FD or, even if acted on, the force is weaker than in the part placed on the first tray 312. This results in a weaker force with which the end part of the sheet PaC on the upstream side in the sheet discharge direction FD is pushed by the upright wall 102, and helps suppress an increase in the degree of curl in the end part of the sheet PaC on the upstream side in the sheet discharge direction FD.

The part of the sheet PaC placed on the second tray 32 is, under the self weight, pressed against the second tray 32. The second tray 32 has a gentler inclination compared with the first tray 312; thus the force that acts downward along the second tray 32 on the part placed on the second tray 32 is weaker than in the part placed on the first tray 312. Thus, rotating the second tray 32, compared with not rotating it, helps suppress an increase in the degree of curl, under the self weight, of the end part of the sheet PaC on the discharge downstream side under the self weight.

As will be understood from what has been discussed above, it is possible, by bending the second tray 32, to keep the degree of curve in the sheet PaC small. By so doing, even when an image is recorded on a sheet that is long in the sheet discharge direction FD and of which an end part curls easily, it is possible to suppress untidy stacking of sheets on the sheet discharge tray 30 resulting from a curl in the sheet PaC.

The present disclosure is not limited to the embodiment described above and allows many modifications without departing from the spirit of the disclosure. For example, the embodiment described above deals with an example where the second tray 32 stops at a given one angle relative to the first tray 312; instead, for example, between the first and second contact surfaces 317 and 318, there may be provided a plurality of surfaces of which the angles with respect to the horizontal plane fall between the first and second contact surfaces 317 and 318. With this arrangement, it is possible to adjust the angle of the second tray 32 from the state where the second tray 32 lies along the first tray 312. The adjustment can be performed based on, for example, the degree of curl that depends on sheet size or on the type of recorded image (such as a photograph, a line diagram, and characters).

The embodiment described above deals with, as an example, a printer 100 of an inkjet-recording type, that is, a printer that records an image by ejecting ink from the ink ejection nozzles of the line heads 10C to 10C onto a sheet P. The present disclosure, however, is not limited to inkjet-recording printers 100; it applies as well to image forming apparatuses of an electrophotographic type, that is, those that irradiate an image carrying member such as a photosensitive drum with a laser beam to form an electrostatic latent image, then attach toner to the electrostatic latent image to form a toner image, then transfer the toner image to a sheet (recording medium), and then apply heat and pressure to the transferred unfixed toner image to turn it into a permanent image.

In that case, the curl in sheet is not always due to ink drying; curl can be caused by, for example, heat and pressure when these are applied. Otherwise, curl resulting from, for example, the shape of a conveying passage can also be coped with.

The description of the embodiment given above is not meant to limit the present disclosure, which can thus be implemented with many modifications made without departure from the spirit of the disclosure.

INDUSTRIAL APPLICABILITY

The present disclosure finds applications as sheet discharge trays that are provided in printers, copiers, facsimile machines, and the like for the purpose of receiving printed sheets when these are discharged.

What is claimed is:

1. A sheet discharge tray for receiving a discharged sheet, comprising:

a frame having a bottom portion; and a pair of wall portions provided at opposite ends of the bottom portion in a width direction perpendicular to a sheet discharge direction, the wall portions extending in the sheet discharge direction;

a first tray fixed to the frame over the bottom portion, in an inclined state upward toward a downstream side in the sheet discharge direction;

a second tray supported, movably in the sheet discharge direction, on the pair of wall portions between the bottom portion and the first tray; and an angle switching member supported movably on the pair of wall portions under the second tray, wherein the second tray is movable to a first position at which at least part of the second tray overlaps the first tray, a second position to which the second tray is extended by being moved toward a downstream side in the sheet discharge direction relative to the frame, and a third position which is to a downstream side of the second position in the sheet discharge direction at the third position, the second tray is rotatable about, as a pivot, an upstream side thereof in the sheet discharge direction, in coordination with movement of the second tray, the angle switching member moves along the pair of wall portions and, at a downstream-side end part of the pair wall portions in the sheet discharge direction, the angle switching member rotates downward through a predetermined angle and is then held by the pair of wall portions, the angle switching member is capable of changing an inclination angle of the second tray when the second tray is at the third position, when the second tray is at the third position, the angle switching member rotates the second tray and supports the second tray at a second inclination angle with respect to a horizontal direction, the second inclination angle being smaller than a first inclination angle of the second tray with respect to the horizontal direction when the second tray is at the second position, and the first and second inclination angles are both smaller than 90 degrees.

2. The sheet discharge tray according to claim 1, wherein each of the pair of wall portions has a first contact surface arranged in a downstream- side end part in the sheet discharge direction, the first contact surface extending in the sheet discharge direction and overhanging in a width direction perpendicular to the sheet discharge direction, the angle switching member has a flat-plate portion facing a lower surface of the second tray and extending in the width direction; and a pair of guide wall portions upright from opposite ends of the flat-plate portion in the width direction and coupled to the pair of wall portions of the frame, the angle switching member has a rotation restricting portion that is provided on each of the pair of guide wall portions, the rotation restricting portion is rotating in coordination with the second tray while at least the second tray rotates at the third position, the rotation restricting portion is making contact with the first contact surface while the second tray is at a predetermined angle relative to the first tray.

3. The sheet discharge tray according to claim 2, wherein the second tray includes an engaging portion that protrudes downward from the lower surface thereof, and the angle switching member includes an engaged portion that protrudes from the flat-plate portion toward the second tray and that is engageable with the engaging portion in the sheet discharge direction when the second tray moves.

4. The sheet discharge tray according to claim 3, wherein the angle switching member includes an engagement adjustment member that protrudes from the flat-plate portion toward the lower surface of the second tray, the engagement adjustment member adjusting a distance between the lower surface of the second tray and a upper surface of the flat-plate portion by changing an amount of protrusion of the engagement adjustment member, and by increasing the distance, the engagement adjustment member permits disengagement of the engaging portion with the engaged portion and movement of the second tray to the third position, and by reducing the distance, the engagement adjustment member inhibits disengagement of the engaging portion with the engaged portion and movement of the second tray to the third position.

5. The sheet discharge tray according to claim 2, wherein the frame further has a cylindrical support shaft that extends from each of the pair of wall portions in a horizontal direction, outward in the width direction, and the angle switching member has a guide hole that is provided on each of the pair of guide wall portions, the guide hole extending in the sheet discharge direction and being penetrated by the support shaft, the support shaft moving inside the guide hole as the second tray moves in the sheet discharge direction.

6. The sheet discharge tray according to claim 2, wherein the each of the pair of wall potions has a second contact surface that is arranged on an upstream side of the first contact surface in the sheet discharge direction, the second contact surface is inclined so as to be increasingly far from a plane including the first contact surface toward an upstream side in the sheet discharge direction, and when the angle switching member is at a most upstream-side position in the sheet discharge direction, the rotation restricting portion is in contact with the second contact surface.

7. The sheet discharge tray according to claim 2, wherein when the rotation restricting portion is in contact with a lower surface of the first contact surface, an upper surface of the second tray is level with a horizontal plane.

8. An image forming apparatus comprising:

the sheet discharge tray according to claim 1;

a conveying portion that conveys the sheet; and a recording portion that records an image on the sheet conveyed by the conveying portion.

9. A sheet discharge tray for receiving a discharged sheet, comprising:

a frame having a bottom portion; and a pair of wall portions provided at opposite ends of the bottom portion in a width direction perpendicular to a sheet discharge direction, the wall portions extending in the sheet discharge direction;

a first tray fixed to the frame over the bottom portion, in an inclined state upward toward a downstream side in the sheet discharge direction;

a second tray supported, movably in the sheet discharge direction, on the pair of wall portions between the bottom portion and the first tray; and an angle switching member supported movably on the pair of wall portions under the second tray, wherein the second tray is movable to a first position at which at least part of the second tray overlaps the first tray, a second position to which the second tray is extended by being moved toward a downstream side in the sheet discharge direction relative to the frame, and a third position which is to a downstream side of the second position in the sheet discharge direction at the third position, the second tray is rotatable about, as a pivot, an upstream side thereof in the sheet discharge direction, in coordination with movement of the second tray, the angle switching member moves along the pair of wall portions and, at a downstream-side end part of the pair wall portions in the sheet discharge direction, the angle switching member rotates through a predetermined angle and is then held by the pair of wall portions, when the second tray is at the third position, the angle switching member supports the second tray at a second inclination angle smaller than a first inclination angle when the second tray is at the second position, each of the pair of wall portions has a first contact surface arranged in a downstream-side end part in the sheet discharge direction, the first contact surface extending in the sheet discharge direction and overhanging in a width direction perpendicular to the sheet discharge direction, the angle switching member has a flat-plate portion facing a lower surface of the second tray and extending in the width direction; and a pair of guide wall portions upright from opposite ends of the flat-plate portion in the width direction and coupled to the pair of wall portions of the frame, and the angle switching member has a rotation restricting portion that is provided on each of the pair of guide wall portions, the rotation restricting portion is rotating in coordination with the second tray while at least the second tray rotates at the third position, the rotation restricting portion is making contact with the first contact surface while the second tray is at a predetermined angle relative to the first tray.

10. The sheet discharge tray according to claim 9, wherein the second tray includes an engaging portion that protrudes downward from the lower surface thereof, and the angle switching member includes an engaged portion that protrudes from the flat- plate portion toward the second tray and that is engageable with the engaging portion in the sheet discharge direction when the second tray moves.

11. The sheet discharge tray according to claim 10, wherein the angle switching member includes an engagement adjustment member that protrudes from the flat-plate portion toward the lower surface of the second tray, the engagement adjustment member adjusting a distance between the lower surface of the second tray and a upper surface of the flat-plate portion by changing an amount of protrusion of the engagement adjustment member, and by increasing the distance, the engagement adjustment member permits disengagement of the engaging portion with the engaged portion and movement of the second tray to the third position, and by reducing the distance, the engagement adjustment member inhibits disengagement of the engaging portion with the engaged portion and movement of the second tray to the third position.

12. The sheet discharge tray according to claim 9, wherein the frame further has a cylindrical support shaft that extends from each of the pair of wall portions in a horizontal direction, outward in the width direction, and the angle switching member has a guide hole that is provided on each of the pair of guide wall portions, the guide hole extending in the sheet discharge direction and being penetrated by the support shaft, the support shaft moving inside the guide hole as the second tray moves in the sheet discharge direction.

13. The sheet discharge tray according to claim 9, wherein the each of the pair of wall potions has a second contact surface that is arranged on an upstream side of the first contact surface in the sheet discharge direction, the second contact surface is inclined so as to be increasingly far from a plane including the first contact surface toward an upstream side in the sheet discharge direction, and when the angle switching member is at a most upstream-side position in the sheet discharge direction, the rotation restricting portion is in contact with the second contact surface.

14. The sheet discharge tray according to claim 9, wherein when the rotation restricting portion is in contact with a lower surface of the first contact surface, an upper surface of the second tray is level with a horizontal plane.

15. An image forming apparatus comprising:

the sheet discharge tray according to claim 9;

a conveying portion that conveys the sheet; and a recording portion that records an image on the sheet conveyed by the conveying portion.

* * * * *